United States Patent [19]

Ferrero

[11] Patent Number: 4,949,839

[45] Date of Patent: Aug. 21, 1990

[54] PACKAGE FOR FOOD PRODUCTS, PARTICULARLY CONFECTIONERY PRODUCTS SUCH AS SLICES OF CAKE AND THE LIKE

[75] Inventor: Pietro Ferrero, Brussels, Belgium

[73] Assignee: Ferrero S.p.A., Alba, Italy

[21] Appl. No.: 330,215

[22] Filed: Mar. 29, 1989

[30] Foreign Application Priority Data

May 31, 1988 [IT] Italy ..... 53190/88[U]

[51] Int. Cl.[5] ..... B65D 25/00

[52] U.S. Cl. ..... 206/45.32; 206/551; 206/223; 229/906

[58] Field of Search ..... 206/45.32, 45.34, 551, 206/223; 229/906

[56] References Cited

U.S. PATENT DOCUMENTS

| | | | |
|---|---|---|---|
| 3,692,544 | 9/1972 | Dendrinos | 206/45.32 |
| 4,452,356 | 6/1984 | Dahl | 206/45.32 |
| 4,705,163 | 11/1987 | James | 206/45.32 |
| 4,741,452 | 5/1988 | Holzkpf | 206/45.32 |
| 4,776,459 | 10/1988 | Boekerman et al. | 206/45.32 |

FOREIGN PATENT DOCUMENTS 112661 6/1965 Italy .

OTHER PUBLICATIONS

European Search Report–Application No. EP 89 83 0166, 1989.

*Primary Examiner*—Joseph Man-Fu Moy

*Attorney, Agent, or Firm*—Bernard, Rothwell & Brown

[57] ABSTRACT

A package for food products, comprises a flat base constituting a support formation for a food product, a generally trough-shaped transparent cover which can be fitted to cover the product with its open edge resting on the flat base, and a flexible transparent wrapper which can envelop the flat base and the transparent cover. The flat base has appendages which can project beyond the open edge of the cover and are selectively orientable between a packaging position in which the appendages are folded against the transparent cover, and a consumption position in which, the wrapper having been removed, the appendages extend outwardly from the flat base.

2 Claims, 1 Drawing Sheet

Figure 1:
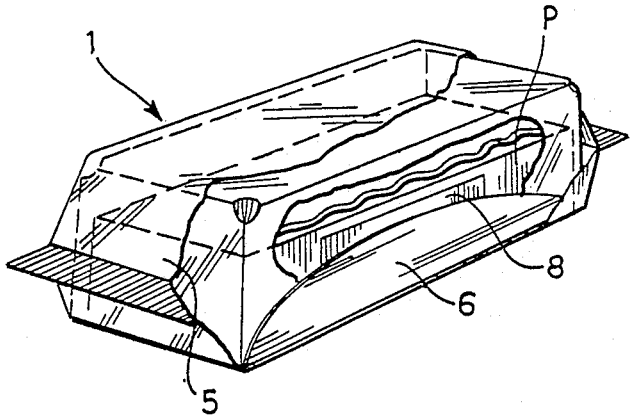

PACKAGE FOR FOOD PRODUCTS, PARTICULARLY CONFECTIONERY PRODUCTS SUCH AS SLICES OF CAKE AND THE LIKE

The present invention relates to packages for food products and particularly concerns a package for food products, comprising:

a flat base constituting a support formation for a food product, a transparent cover which is generally trough-shaped and can be fitted to cover the product with its open edge resting on the flat base, and a flexible transparent wrapper which can envelop the flat base and the transparent cover.

Packages of the type specified above and known, for example, from Italian utility model no. 112,661 in the name of the same Applicant have been used for many years for the sale of confectionery products, such as, for example, slices of cake.

The object of the present invention is to provide a package of the above-specified type, which is further improved in terms of its effectiveness and convenience of application and use, particularly as regards:

the protection of the product which is in the package; in fact, the product must be offered to the consumer in the best possible condition, without being deformed or crushed in transit, the presentation of the product (which is usually a food or confectionery product manufactured on a commercial scale) according to criteria substantially similar to those used for the presentation of food and confectionery products manufactured on a small scale (for example, by a confectioner) or on a domestic scale, and the ability to prevent the product (which usually has a creamy covering) from sticking to parts of the package, smearing them and/or becoming broken up.

According to the present invention, this object is achieved by virtue of a package of the type specified above, characterised in that the flat base has appendages which can project beyond the open edge of the cover and are selectively orientable between:

a packaging position in which the appendages are folded against the transparent cover, and a consumption position in which, the wrapper having been removed, the appendages extend outwardly from the flat base.

In the packaging position, therefore, the appendages of the flat base on which the product is placed extend to protect the walls of the transparent cover and the product within it. The product is consequently protected against deformation and crushing which could be caused by knocks or mechanical forces applied from outside.

In the consumption position, the product sits on the flat base with its appendages projecting outwardly like a small mat. The presentation of the product for eating is thus more pleasing since the presentation echoes that used on a small scale (for example by confectioners) or domestically, and since the appendages of the base portion which define the parts of the mat surrounding the product do not come into contact with the product itself (which is covered by the transparent cover) and therefore do not run the risk of becoming smeared.

Figure 2:
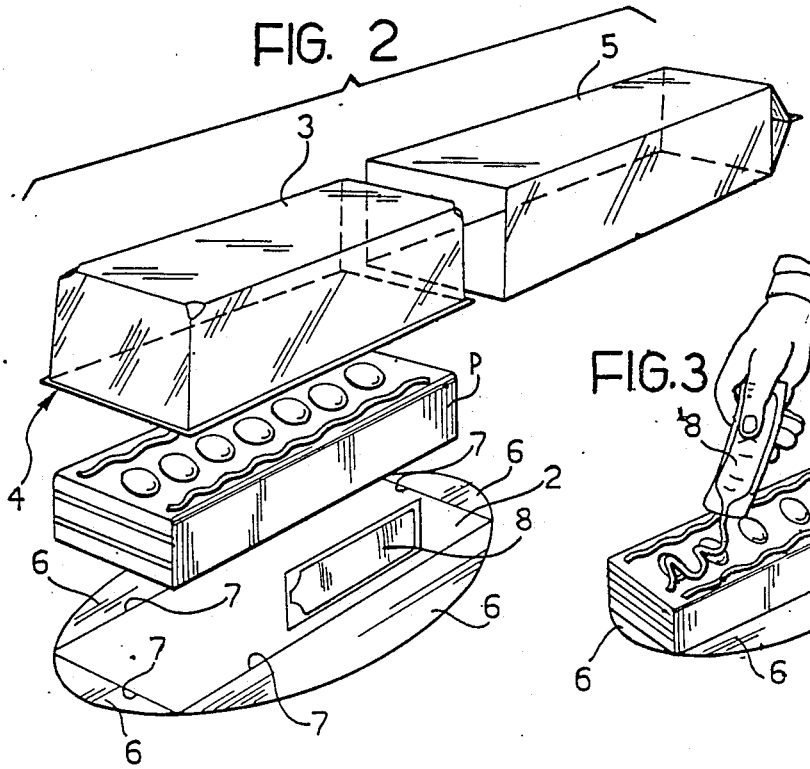
Figure 3:
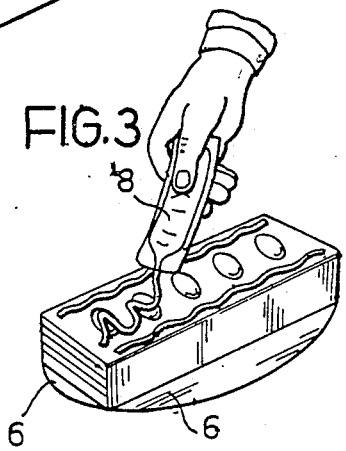

Further characteristics and advantages of the invention will become clear from the description which follows with reference to the appended drawings, provided by way of non-limiting example, in which:

FIG. 1 is a perspective view of a package according to the invention, shown in the condition in which it is presented to the public, FIG. 2 is an exploded perspective view which shows the structure of the package according to the invention, and FIG. 3 shows schematically the condition in which the product in the package is presented to the consumer after some parts of the package have been removed.

In the drawings, a package for food products, generally indicated 1, is preferably intended to be used for the distribution and sale of food products.

In the embodiment illustrated, the packaged product, indicated P, is constituted by a slice of cake at least partly covered with a chocolate-flavoured cream. The slice shown is parallelepipedal with an elongate rectangular shape in plan.

According to a known solution, the product P is placed on a flat base 2 of laminar card which is also rectangular in shape and of slightly larger dimensions than the base of the product P. The latter is protected by a cover 3 which is generally trough-shaped with a height (or more correctly depth) slightly greater than the thickness of the product P.

The cover 3 is applied to cover the product P by bringing its open edge 4 to bear against the periphery of the flat base 2. The fact that the cover 3 is made of transparent material enables the product P to be seen from outside even when it is packaged.

Finally, a flexible wrapper of transparent material (of the type currently known as a "flow-pack") is indicated 5 and is intended to envelop the product P, which is enclosed between the flat support 2 and the cover 3, sealing it from the outside atmosphere.

The main characteristic of the invention is the fact that the base 2 is provided with four appendages 6 which can project beyond the sealing edge 4 of the cover 3.

The appendages 6 are formed integrally with the flat base 2 and are each shaped approximately like a circular segment.

In practice, the unit constituted by the base 2 and the appendages 6 is made from a single sheet of card cut into a general oval or elliptical shape and folded along folding lines 7 which define the sides of the rectangular base 2 on which the product P is placed.

The appendages 6 can therefore be oriented between a closed position against the sides of the cover 3 (the packaging position) and an open position in which the appendages 6 extend outwardly from the flat base 2 and are substantially coplanar therewith (the consumption position).

The first position is the one the appendages 6 assume in the package 1 when the enveloping wrapper 5 is present. Under these conditions (see FIG. 1), the appendages 6 extend along the sides of the cover 3 to protect the product P inside it against knocks and other forces which might be applied from the outside and deform or crush the product P.

An auxiliary packet-like wrapper 8 constituted (according to a known solution) by a sachet which can be torn open and contains a liquid or creamy substance (for example, a hazel nut-flavoured cream, which can be used to decorate the product P immediately before it is eaten) may also be inserted between one of the sides of the cover 3 and the appendage 6 folded against it.

In this case, the appendage 6 in question also protects the auxiliary wrapper 8, preventing it from being accidentally punctured or torn from the outside.

In order to reach the product, the consumer must first remove the transparent wrapper 5, after opening or tearing it, and then remove the transparent cover 3.

At this point, the product can be presented on the flat base 2 on which it rests, after the appendages 6 have been opened out, and the product P can then be decorated with the contents of any auxiliary wrapper 8.

The outward extension of the appendages 6 simulates with particular effectiveness the presentation of the product P on a small mat such as those currently used for the presentation of similar food products on a small scale (for example, by confectioners) or on a domestic scale.

Naturally, the scope of the present invention extends to models which achieve equal utility by means of the same innovative concept.

What is claimed is:

1. A package for food products, comprising:

a flat base having four sides constituting a support formation for a food product, a transparent cover which is generally trough-shaped and can be fitted to cover the product with its open edge resting on the flat base, and a flexible transparent wrapper which can envelop the flat base and the transparent cover, wherein the flat base has an appendage extending from each of the four sides of the base, wherein the appendages can project beyond the open edge of the cover and are selectively orientable between a packaging position in which the appendages are folded against the transparent cover, and a consumption position in which, the wrapper having been removed, the appendages extend outwardly from the flat base, and wherein said package includes an auxiliary container for a decorative product, the auxiliary container having a generally flattened shape and being insertable between the transparent cover and one of the said appendages of the flat base which is folded against the transparent cover in the packaging position.

2. A package for food products, comprising:

a flat base constituting a support formation for a food product, a transparent cover which is generally trough-shaped and can be fitted to cover the product with its open edge resting on the flat base, and a flexible transparent wrapper which can envelop the flat base and the transparent cover, wherein the flat base has appendages which can project beyond the open edge of the cover and are selectively orientable between a packaging position in which the appendages are folded against the transparent cover, and a consumption position in which, the wrapper having been removed, the appendages extend outwardly from the flat base, wherein the flat base and the appendages as a whole are shaped like an oval mat; wherein the flat base and the appendages are formed from a single piece of laminar material, and wherein said package includes an auxiliary container for a decorative product, the auxiliary container having a generally flattened shape and being insertable between the transparent cover and one of the said appendages of the flat base which is folded against the transparent cover in the packaging position.

* * * * *